United States Patent [19]

Priggs

[11] 4,069,552

[45] Jan. 24, 1978

[54] SHELLFISH OPENING TOOL

[76] Inventor: Anthony Priggs, 465 Silver Lane, East Hartford, Conn. 06118

[21] Appl. No.: 716,680

[22] Filed: Aug. 23, 1976

Related U.S. Application Data

[63] Continuation-in-part of Ser. No. 603,688, Aug. 11, 1975, abandoned.

[51] Int. Cl.[2] ..... A22C 29/04

[52] U.S. Cl. ..... 17/75; 17/76

[58] Field of Search ..... 17/76, 74, 75; 30/120.1, 120.2; 99/628

[56] References Cited

U.S. PATENT DOCUMENTS

| | | | |
|---|---|---|---|
| 144,063 | 10/1873 | Cleary | 17/74 |
| 1,060,502 | 4/1913 | Savieo | 17/76 |
| 1,465,799 | 8/1923 | Aszklar | 17/76 |
| 1,510,313 | 9/1924 | Dickerson | 17/76 |
| 2,942,292 | 6/1960 | Rey | 17/76 X |
| 3,548,450 | 12/1970 | Helmer | 17/76 |
| 3,583,026 | 6/1971 | Peoni | 17/76 |
| 3,748,692 | 7/1973 | Valentino | 17/76 |

*Primary Examiner*—David H. Brown

[57] ABSTRACT

Apparatus having utility in the manual opening of shellfish characterized by oppositely disposed pairs of gripping portions which receive both hands of a user thus precluding the placing of digits in registration with a movable blade disposed intermediate the pairs of gripping portions. The blade is mounted on a movable frame between two gripping portions and the apparatus further includes a spring biased blade guide movable on the frame.

16 Claims, 4 Drawing Figures

SHELLFISH OPENING TOOL

CROSS-REFERENCE TO RELATED APPLICATION

This application is a continuation-in-part of application Ser. No. 603,688 filed Aug. 11, 1975 and now abandoned.

BACKGROUND OF THE INVENTION

1. Field of the Invention

The present invention relates to the opening of shellfish such as oysters and clams. More specifically, this invention is directed to a novel and improved implement for use in the opening of shellfish. Accordingly, the general objects of the present invention are to provide novel and improved methods and apparatus of such character.

2. Description of the Prior Art

Shellfish, and particularly oysters and clams, retain their taste and freshness better if opened immediately prior to consumption. The edible portion of a shellfish can, of course, be obtained only after the outer shell is opened. A rather strong muscle binds or normally maintains the two hinged portions of the outer shell of oysters and clams in a closed position and, prior to consumption, these shell portions must be forced apart to obtain the body or "meat" of the fish.

The opening of shellfish, for example clams, ordinarily requires the exercise of a considerable degree of manual dexterity and skill. This is particularly true in the case of commercial operations such as restaurants and situations, such as clambakes, where a considerable number of persons are to be served. To facilitate the opening of shellfish, various hand manipulated implements have been designed. The more popular of these implements are of the plier or lever type and include a pair of pivotally interconnected levers with a knife blade on one jaw which pivots relative to a cup-shaped shellfish supporting portion on the other jaw. In the use of these prior art tools, the shellfish is placed between the blade and supporting lower portions and, by squeezing together handle ends of the levers disposed at the opposite side of the pivot connection from the shellfish contacting portions, the knife blade is forced between the shell portions and thus advanced through the shellfish towards the cup-shaped supporting lever portion. Implements of this type are disclosed in, by way of example only, U.S. Pat. Nos. 3,685,097 and 3,846,908.

While the use of shellfish opening implements of the type exemplified by the above-mentioned patents constitutes, particularly for the casual user, a substantial improvement over the use of a special form of knife, shellfish opening tools of the plier type are none-the-less dangerous to use. It is not uncommon for the shellfish, when subjected to pressure caused by the squeezing of the lever handles, to slip slightly out of position between the jaws of the tool. The natural reaction is to steady the shellfish with one hand while applying pressure with the other hand. As will be obvious, this places the steadying hand between the jaws of the tool and serious injuries have been known to result in cases where the shellfish has slipped from the opening implement.

SUMMARY OF THE INVENTION

The present invention overcomes the above briefly discussed and other deficiencies and disadvantages of the prior art by providing a novel and improved technique for the opening of shellfish and a tool for use in the practice of such technique. The invention is characterized by an implement which, when employed to open shellfish, must be gripped by both of the user's hands at points remote from the cutting blade.

In accordance with a first embodiment, the invention comprises an elongated base member having a pair of spatially displaced upwardly extending guide pins mounted thereon. The base member may, if deemed necessary or desirable, be provided with a recess intermediate the guide pins for locating and partially supporting a shellfish positioned on its edge. The base member also has, extending inwardly from the oppositely disposed ends thereof, handle or grip portions. A movable knife frame is mounted for movement on the guide pins. The frame is provided, to the outside of the guide pins, with outwardly extending handle portions which are generally commensurate in shape with and aligned with the handle portions of the base member. The frame is also provided, in the region intermediate the guide pins, with a U-shaped upward extension. A replaceable blade, typically sharpened on both sides, spans the open end of the main frame extension and thus faces the base member. A locator and blade guide, resiliently biased toward the base member, is mounted within the U-shaped extension of the frame and is movable relative thereto.

In use a shellfish is positioned on edge on the base member and the movable frame is caused to move toward the base member until the cutting blade contacts the edge of the shellfish along the dividing line between the shell halves. At this time the locater and blade guide will be resiliently urged against the shellfish and the shellfish will be in part supported by a generally V-shaped groove in the bottom of the blade guide. The two handle portions of the frame and base member will then be simultaneously grasped and the blade will be forced into the shellfish by squeezing the handle portions thus urging the base member and frame toward one another. As the base member and knife supporting frame move toward one another the blade guide will move upwardly in the U-shaped extension of the frame.

In accordance with a second embodiment of the invention, the pair of guide posts extending upwardly from the base member are replaced by springs. These springs are bonded, at their opposite ends, respectively to the base member and knife frame. The manner of use of the second embodiment of the invention is identical to that of the first embodiment. During the opening of a bivalve with a tool in accordance with the second embodiment of the invention the pair of springs extending between the base member and knife frame are compressed as the shellfish is opened by forcing the knife blade therethrough.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 2:
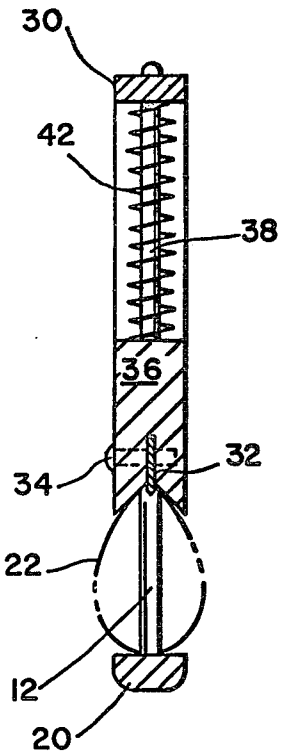
FIG. 2 is a cross-sectional view, taken along line 2—2 of FIG. 1, of the implement of FIG. 1.

With reference to the drawing, a shellfish opener in accordance with a first embodiment of the invention is provided with a base member indicated generally at 10. Base member 10 has, extending upwardly therefrom, a pair of transverse parallelly oriented guide pins 12 and 14. The guide pins 12 and 14 divide base member 10 into a pair of oppositely disposed spatially displaced handle portions 16 and 18 and an intermediate shellfish supporting portion 20. The shellfish supporting portion 20 may, if deemed necessary or desirable, be provided with a suitably shaped recess which receives the edge of a clam or other shellfish, such as indicated at 22, and thus aids in the supporting of the shellfish in the implement.

The preferred embodiment of the invention also comprises, mounted for sliding movement toward and away from base member 20 on guide pins 12 and 14, a main frame member indicated generally at 24. Main frame member 24 is provided with a pair of spatially displaced handle portions 26 and 28 which are situated to the outside of guide pins 12 and 14. Handle portions 26 and 28 of the main frame member 24 are commensurate in size and shape with the handle portions 16 and 18 of base member 10 and the pair of handle portions 16 and 26 and the pair of handle portions 18 and 28 are each respectively intended and designed for simultaneous gripping by one hand of a user.

The portion of the main frame member 24 intermediate guide pins 12 and 14 is formed into an upwardly extending generally U-shaped portion 30. The U-shaped portion 30 of member 24 has its open end facing toward base member 10 and the opposite sides of frame portion 30 are parallel to the axis of guide pins 12 and 14; the side edges of portion 30 of main frame member 24 thus being flat and parallel.

A cutting blade 32 spans the open end of U-shaped portion 30 of frame member 24 as shown. Blade 32 is provided with apertures adjacent its oppositely disposed ends and is received in slots which are provided in the facing ends of the base of the U-shaped portion 30 of frame 24; such slots also communicating with the bottom of frame member 24 to permit insertion of the blade. The apertures at the opposite ends of blade 32 will, with the blade inserted, be in registration with tapped holes provided in frame member 24 and, to retain the blade in position, screws 34 will be passed through the holes in the blade and be engaged by the frame member 24. The blade 32 will typically be comprised of stainless steel and will be sharpened on both sides. This arrangement; i.e., the sharpening of the blade on both sides, increases the useful life thereof since the blade may be reversed when a first side becomes dull merely by means of removing screws 34.

The disclosed embodiment of the invention is also provided with a shellfish locater and blade guide member 36. Member 36 is of proper dimensions so as to slide within and be guided by the side walls of U-shaped portion 30 of frame member 24. Blade guide 36 has, extending upwardly therefrom, a pair of parallel guide pins 38 and 40. Guide pins 38 and 40 pass through apertures provided in the base; i.e., the upper side; of portion 30 of member 24. Springs 42 and 44 are respectively positioned about guide pins 38 and 40. Springs 42 and 44 are in compression between the top of blade guide 36 and the inner side of the upper or base of U-shaped portion 30 of frame member 24. Thus, the springs 42 and 44 urge the blade guide downwardly as the implement is shown in the drawing.

As may best be seen from FIG. 2, blade guide 36 is also provided with a generally V-shaped groove in its lower side. This groove is designed to receive and support a shellfish, such as clam 22, prior to the forcing of the blade 32 between the shell halves. The blade guide 36 is provided, at the base of the V-shaped shell receiving groove, with an upwardly extending slot which receives blade 32. Thus, with the implement in its normal or rest position prior to a positioning of a shellfish between the center portion 20 of base member 10 and blade 32, the blade guide 36 will be resting on the top of blade 32 under the influence of springs 42 and 44 and the blade will thus be substantially sheathed. It will be understood that if the implement is stored in the upright position shown in the drawing the frame member 24 will be resting on the base member 10 and springs 42 and 44 will be compressed.

In use a shellfish, for example the clam shown in phantom at 22, is placed on edge on base member 10 and the main frame 24, which had previously been raised, is moved downwardly until blade 32 engages the clam along the dividing line between the two shell halves. At this time, as may best be seen from FIG. 2, the edge of the shellfish will be received in and steadied by the V-shaped groove in the base of blade guide 36. The user of the implement will thereupon grasp handle portions 16 and 26 in one hand and handle portions 18 and 28 in the other hand and will squeeze the handle portions together. This action will cause the base member 10 and main frame member 24 to move toward one another and the blade 32 to be forced between halves of the shell of clam 22 thus opening the shellfish. As base member 10 and frame member 24 are moved toward one another, the shellfish will force blade guide member 36 upwardly along guide pins 38 and 40 thus compressing springs 42 and 44. Thus, the blade guide 36 will not interfere with the opening operation since it will remain in the same relative position with respect to the shellfish as the blade is forced between the halves thereof.

Figure 1:
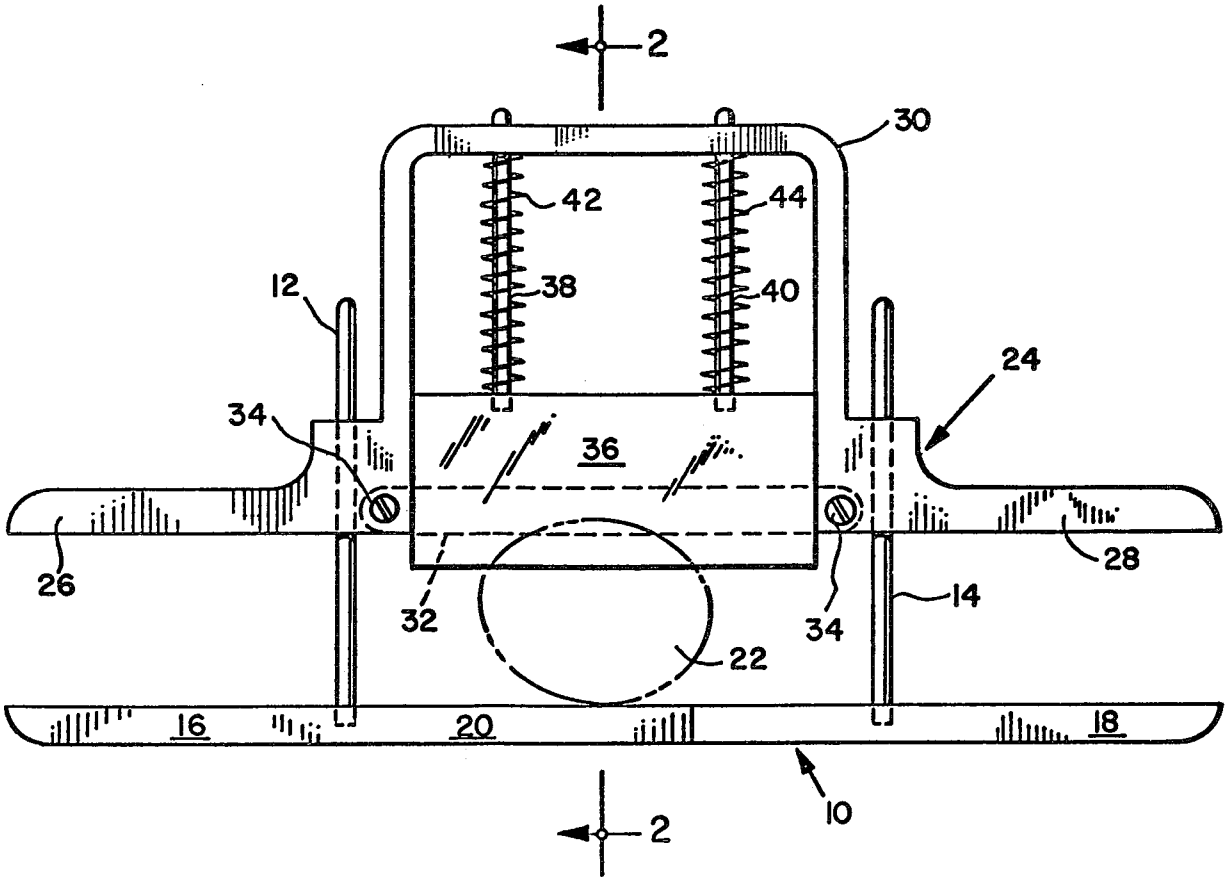
FIG. 1 is a side elevation view of a first embodiment of a shellfish opening implement in accordance with the present invention.
Figure 3:
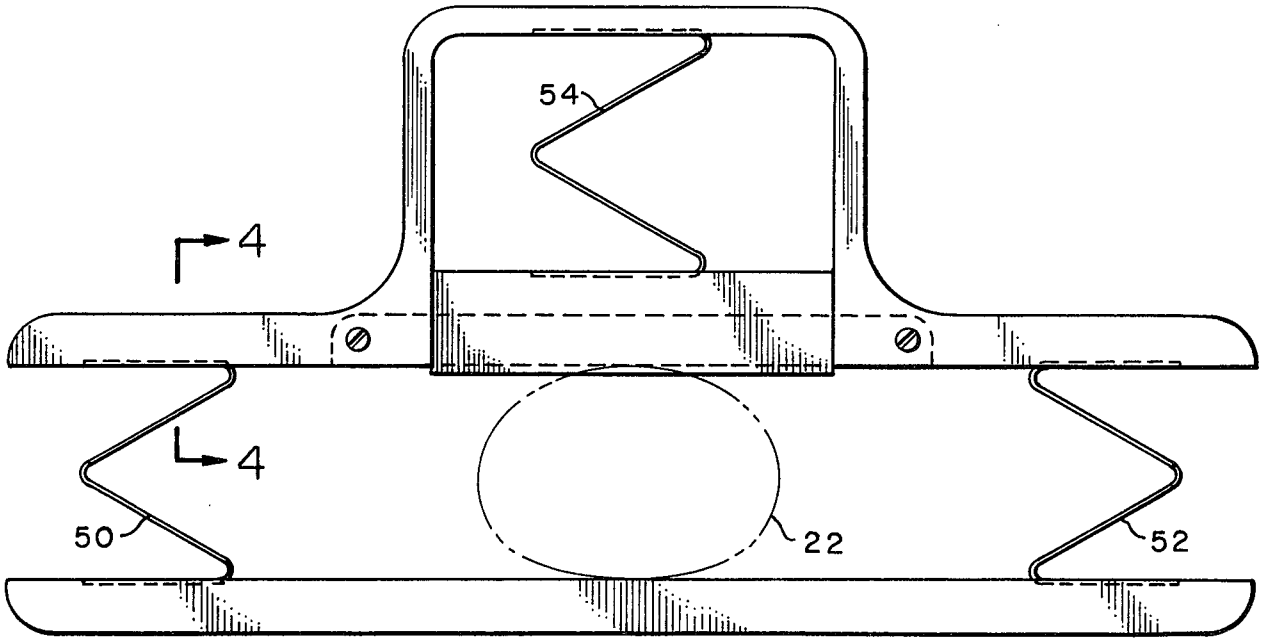
FIG. 3 is a side elevation view of a second embodiment of a shellfish opening implement in accordance with the present invention.
Figure 4:
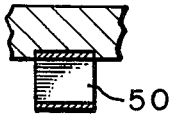
FIG. 4 is a partial cross-sectional view, taken along line 4—4 of FIG. 3, of the implement of FIG. 3.

The embodiment of FIGS. 3 and 4 is functionally equivalent to the embodiment of FIGS. 1 and 2. In the embodiment of FIGS. 3 and 4, however, the guide pins 12 and 14 have been replaced, respectively, by springs 50 and 52. Also, the guide pins 38 and 40 and their respective springs 42 and 44 have been replaced by a single spring 54. Springs 50, 52 and 54 are, in the disclosed embodiment, generally M-shaped. The side legs of each of these M-shaped springs is received in a slot or groove and the springs are bonded, either adhesively or by means of a fusion bond, to the members they contact. Thus, springs 50 and 52 are affixed, at their oppositely disposed ends, to base member 10 and main frame member 24; these springs thus providing the means by which the shellfish opener is held together as a unitary tool. Similarly, spring 54 is bonded at its opposite ends to the blade guide 36 and the upper inside of portion 30 of main frame member 24. As will be obvious to those skilled in the art, the embodiment of FIGS. 3 and 4 offers certain manufacturing economics when compared to the embodiment of FIGS. 1 and 2. If deemed necessary or desirable, in the embodiment of FIGS. 3 and 4 the blade guide 36 may engage the side legs of U-shaped portion 30 of frame member 24 by means of a tongue and groove arrangement. The manner of use of the embodiment of FIGS. 3 and 4 is identical to the usage of the embodiment of FIGS. 1 and 2 as described above.

As should now be obvious, a shellfish opening implement in accordance with the present invention is characterized by inherent safety of use, the ability to accept shellfish of different sizes and of a relatively long operating life since the comparatively inexpensive blade 32 may be reversed and ultimately replaced. This may be contrasted with prior art clam opener tools of the plier type wherein sharpening of the blade is exceedingly difficult and thus, for all practical purposes, the tool must be discarded when the blade becomes dull.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A tool for use in the opening of bivalves comprising:

a first frame member, said first frame member having first and second linearly aligned and spatially displaced handle portions;

a second frame member, said second frame member having first and second linearly aligned and spatially displaced handle portions;

means supporting said frame members for relative motion therebetween and with said first and second handle portions on each of said frame members being in registration; and a cutting blade mounted on said first of said frame members intermediate the handle portions thereof.

2. The tool of claim 1 further comprising:

a blade guide movably supported on said first of said frame members, said blade guide being provided with a slot which substantially sheaths said cutting blade when there is no bivalve positioned in contact therewith; and means for resiliently biasing said blade guide toward said cutting blade.

3. The tool of claim 1 wherein said supporting means comprises:

first spring means, said first spring means extending between a first pair of registered handle portions of said first and second frame members, the opposite terminations of said first spring means being affixed to said first and second frame members; and second spring means, said second spring means extending between a second pair of registered handle portions of said first and second frame members, the opposite terminations of said second spring means being affixed to said first and second frame members.

4. The apparatus of claim 1 wherein said supporting means comprises:

a first pair of displaced guide rods affixed to and extending outwardly from one of said frame members, said guide rods being parallel to each other and passing through the other of said frame members.

5. The tool of claim 1 wherein said first frame member includes:

a generally U-shaped portion interconnecting said handle portions, said U-shaped portion opening toward said second frame member, said cutting blade spanning said U-shaped portion.

6. The tool of claim 5 wherein said cutting blade is detachably mounted to said first of said frame members.

7. The tool of claim 5 further comprising:

a blade guide movably supported on said first of said frame members, said blade guide being provided with a slot which substantially sheaths said cutting blade when there is no bivalve positioned in contact therewith; and means for resiliently biasing said blade guide toward said cutting blade.

8. The tool of claim 7 wherein said blade guide is provided, on the side facing the second of said frame members, with a generally V-shaped groove which communicates at its narrow end with the cutting blade receiving slot.

9. The tool of claim 7 wherein said cutting blade is detachably mounted to said first of said frame members.

10. The tool of claim 9 wherein said supporting means comprises:

first spring means, said first spring means having oppositely disposed end portions and extending between a first pair of registered handle portions of said first and second frame members, the opposite end portions of said first spring means being affixed to said first and second frame members; and second spring means, said second spring means having oppositely diposed end portions and extending between a second pair of registered handle portions of said first and second frame members, the opposite end portions of said second spring means being affixed to said first and second frame members.

11. The tool of claim 9 wherein said supporting means comprises:

a first pair of displaced guide rods affixed to and extending outwardly from one of said frame members, said guide rods being parallel to each other and passing through the other of said frame members.

12. The tool of claim 11 wherein said blade guide further comprises;

a second pair of spatially displaced parallel guide pins extending outwardly from the side of said blade guide disposed oppositely to said slot, said guide pins of said second pair passing through the base of the U-shaped portion of said first of said frame members.

13. The tool of claim 9 wherein said blade guide is provided, on the side facing the second of said frame members, with a generally V-shaped groove which communicates at its narrow end with the cutting blade receiving slot.

14. The tool of claim 13 wherein said supporting means comprises:

a first spring, said first spring having a pair of generally planar and parallel end portions, said first spring extending between a first pair of registered handle portions of said first and second frame members, the end portions of said first spring being affixed to said first and second frame members; and a second spring, said second spring having a pair of generally planar and parallel end portions, said second spring extending between a second pair of registered handle portions of said first and second frame members, the end portions of said second spring being affixed to said first and second frame members.

15. The tool of claim 13 wherein said supporting means comprises:

a first pair of spatially displaced guide pins affixed to and extending upwardly from said second of said frame members, said guide pins of said first pair being parallel to one another and passing through said first of said frame members.

16. The tool of claim 15 wherein said blade guide further comprises:

a second pair of spatially displaced parallel guide pins extending outwardly from the side of said blade guide disposed oppositely to said slot, said guide pins of said second pair passing through said U-shaped portion of said first of said frame members.

* * * * *